United States Patent [19]

Gittins, Sr.

[11] 4,291,908

[45] Sep. 29, 1981

[54] SAFETY GATE LATCH SYSTEM

[76] Inventor: Marvin W. Gittins, Sr., 3601 Twin City Dr., Council Bluffs, Iowa 51501

[21] Appl. No.: 171,898

[22] Filed: Jul. 24, 1980

[51] Int. Cl.[3] ..... E05C 19/04

[52] U.S. Cl. ..... 292/299

[58] Field of Search ..... 292/299, 52, 54, DIG. 13

[56] References Cited

U.S. PATENT DOCUMENTS

| | | | |
|---|---|---|---|
| 2,155,808 | 4/1939 | Swetman | 292/299 |
| 2,609,223 | 9/1952 | Adams | 292/299 |
| 3,523,705 | 8/1970 | Gittins et al. | 292/299 |

*Primary Examiner*—Richard E. Moore

*Attorney, Agent, or Firm*—Hiram A. Sturges

[57] ABSTRACT

A safety gate latch system having a gate tongue, first and second rings on opposite sides of the gate tongue and held in a frame in a manner such that when the rings are down, the gate tongue cannot move past either ring, a post-tongue, a second ring frame attached to the gate tongue and supporting primary and secondary safety rings disposed on opposite sides of the post-tongue whereby a gate using said system cannot be opened in a direction without the lifting of one of the first and second rings and also one of the safety rings.

2 Claims, 6 Drawing Figures

SAFETY GATE LATCH SYSTEM

BACKGROUND OF THE INVENTION

The gate latch assembly of this invention is particularly designed for operation from a side of the gate opposite to the side on which the gate is latched, and this invention is particularly an improvement upon gate latches of the kind that use a ring for latching purposes, such as shown in U.S. Pat. No. 3,523,705, issued Aug. 11, 1970 to Marvin W. Gittins and Vern L. Gittins, titled: Gate Latch.

This invention is also particularly an improvement over the gate latch described in U.S. patent application Ser. No. 018,286, titled: Gate Latch with Release, filed Mar. 6, 1979 by Marvin W. Gittins, Sr.

Although the latch of the patent application provided a way to lift a ring from the opposite side of the gate, yet there has always been important need for extra safety to prevent animals and toddler-children from opening the lever-operated type of gate latch, or the non-lever-operated type of the U.S. Pat. No. 3,523,705.

If an intelligent dog can open a gate latch, then an entire field of cattle might escape. If a toddler can open a gate latch, then that toddler and even other toddlers and animals might escape and come into serious danger on highways and even a more serious common danger on city streets.

It is the main objective of this invention to provide a two-way gate latch with two extra safety rings disposed on opposite sides of the gate-post mounted element which can be called a post-tongue, although I use an anti-sag bar as the post-mounted element, a double use of the same element.

I have discovered that although an adult will find it very convenient to simultaneously press down on a ring-lifting lever with the thumb while raising the adjacent safety ring with the index finger, yet a toddler will not do so.

A toddler or an animal that might press down on the top of the safety lever will not have the intelligence or the information to simultaneously lift and hold in an upper position the upper rign and the safety ring involved throughout the time interval while the gate is pushed to the open position.

I have discovered that even an accidental opening manipulation of lever and safety ring will not make it possible for a toddler to open the gate, unless a toddler maintains these rings in lifted position throughout a simultaneous pushing of the gate toward an open position.

It is true that a toddler might lift a top ring and a lower safety ring that are on the same side of the gate simultaneously and perhaps even move the gate at the same time. But, such would not unlock the gate because, even though the upper ring may be up and in gate-releasing position, yet the movement of the gate tongue toward the raised upper ring will be arrested by the safety ring of this invention which is on the opposite side of the gate from the two rings the toddler has raised.

SUMMARY OF THE INVENTION

A major goal of this invention is to provide a safety gate latch system having a gate tongue, first and second rings on opposite sides of the gate tongue and held in a frame in a manner such that when the rings are down, the gate tongue cannot move past either ring, a post tongue, a second ring frame attached to the gate tongue and supporting primary and secondary safety rings disposed on opposite sides of the post tongue whereby a gate using said system cannot be opened in a direction without the lifting of one of the first and second rings and also one of the safety rings.

A further goal of this invention is to provide a gate tongue being held to a gate by a U-bolt and having a recess into which the U-bolt is welded.

DESCRIPTION OF THE PREFERRED EMBODIMENT

Figure 1:
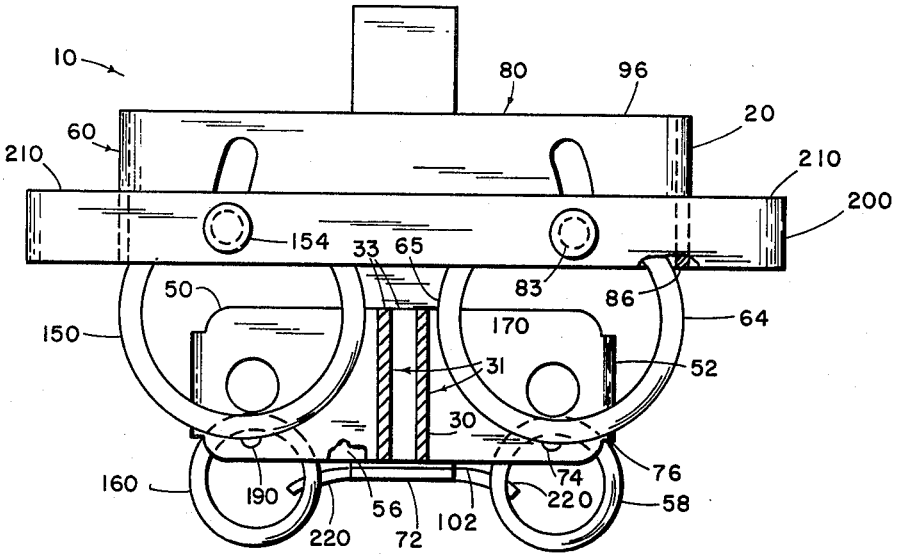
FIG. 1 is an elevation of a safety gate latch in a gate latching position, the portion of the gate tongue which attaches to the swinging portion of the gate being broken away.

In FIG. 1 a safety gate latch is generally indicated at 10. An upper gate latch assembly is generally indicated at 20 and has a gate tongue 30 which is adapted to be attached to the free end of a gate latching portion 31.

Figure 4:
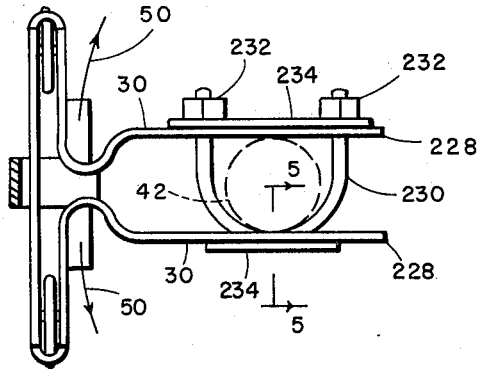
FIG. 4 is a top plan view of the gate tongue of the safety gate latch of FIG. 1, the tongue being secured to a swinging gate shown in dotted lines.

The tongue 30 swings in a circular arc 50 of FIG. 4 in a horizontal plane. The tongue extends substantially radially with respect to the arc 50.

In FIG. 1 an upper gate tongue-securing assembly 60 has a first upper ring 64. The tongue 30 is disposed on a certain side 65 of the first upper ring 64 when the gate latch is in a gate closed position.

In FIG. 4 the first upper ring 64 has first and second opposite sides 68 which lie in substantially parallel vertical planes 90, each substantially tangent to the swinging arc 50.

An upper ring-receiving frame 80 has portions 82 and 84 which are disposed one on each of the sides of the first upper ring 64, and are used to maintain the sides 68 of the first upper ring 64 in the plane 90.

The upper ring-receiving frame 80 has an upper ring-receiving recess 96, which movably receives the first upper ring 64.

When the gate latch system 10 is in a latching position, as shown in FIG. 1, the first upper ring 64 has a lower outer surface portion 102 which is inclined with respect to the vertical and normally projects downwardly from the upper ring-receiving frame 80 in the path of the swinging of the tongue 30. This causes the first upper ring 64 to move upwardly by the passing of the tongue under the center of the first upper ring 64.

A first upper ring retainer 83 is attached to the upper ring-receiving frame 80 and extends approximately horizontally through the center opening 94 at the first upper ring 64, in a position such that when an upper portion of the first upper ring 64 engages the first upper ring retainer 83, the lower side of the first ring will be disposed below the upper surface 33 of the latching portion 31 of the tongue 30.

A first upper ring holder 86 is fixed to the upper ring-receiving frame 80 and disposed on an opposite side of the first upper ring 64 from the certain side 65. The first upper ring holder 86 has a lower surface disposed in a position for engaging the outer surface portion 102 of the first upper ring 64 at a time when the first upper ring 64 is in a gate-latching position, and the first upper ring retainer 83 is engaging a wall of the central opening 96 of the first upper ring 64. This prevents the gate from accidentially opening.

A second and similar gate latch assembly 50 for safety has like parts and comprises a lower ring-receiving frame 52 fixed to the gate tongue latching portion 31. The lower ring-receiving frame 52 has a lower ring-receiving recess 56. A primary lower safety ring 58 is mounted in the lower ring-receiving frame 52, in a fashion similar to the way in which the first ring 64 is mounted in the upper frame 80.

Figure 3:
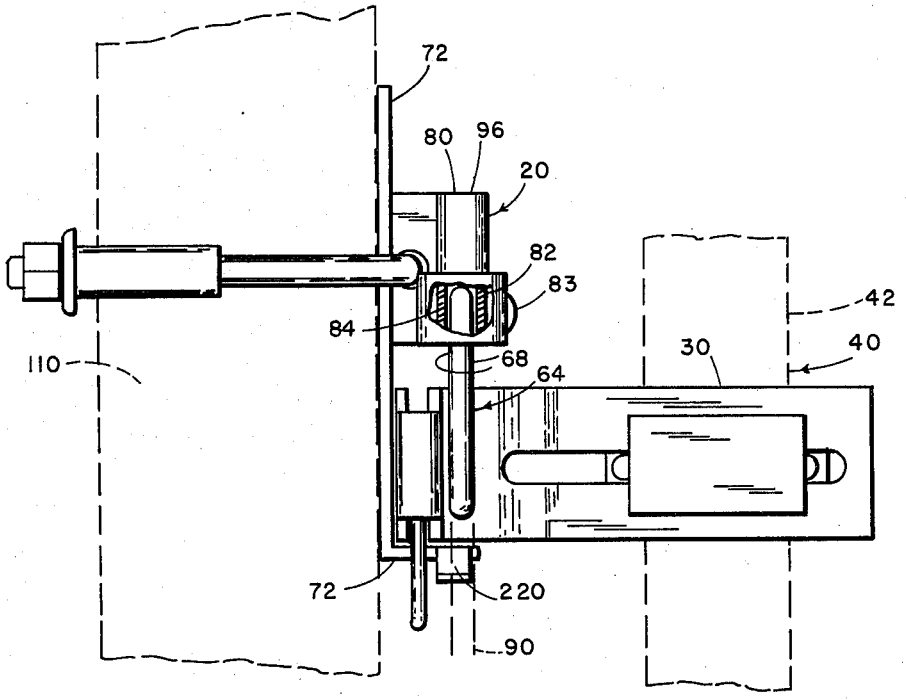
FIG. 3 is a side elevation of the safety gate latch of FIG. 1, showing the connection of the latch to a gate post and a gate, each shown in dotted lines.

In FIG. 3, a post tongue 72 is shown to be attachable to a gate post 110. The post tongue 72 extends across the pathway of the primary lower safety ring 58 at times when the gate-latching system is in a gate latched position.

The second gate latch assembly has a primary lower ring retainer 74 and a primary lower safety ring holder 76, as shown in FIG. 1. Each of these has the same relationship to the lower frame 52 and to the primary lower ring 58 as the first upper ring retainer 83 and the first upper ring-holding means 86 have to the upper frame 80 and to the first upper ring 64.

A second upper ring 150 in FIG. 1 is substantially similar to the first upper ring 64. The second upper ring 150 is disposed in the first recess 96 of the upper frame 80, and is arranged substantially parallel to and horizontally spaced from the first upper ring 64. This causes the gate tongue to be in a space 170 which is between the first and second upper rings 64 and 150 respectively at times when the gate latch system 10 is in a gate-closed position.

A second upper ring retainer 154 is attached to the upper ring-receiving frame 80 and has a similar relationship to the second upper ring 150 and to the upper ring-receiving frame 80 to that which the first upper ring retainer 83 has to the first upper ring 64 and to the first upper frame 80.

A secondary lower safety ring 160 is substantially similar to the primary lower safety ring 58. The secondary lower safety ring 160 is disposed in the lower second ring-receiving recess 56. It is arranged substantially parallel to and spaced from the primary lower safety ring 58, such that in a gate-closed position, the post tongue 72 is disposed between the primary and secondary lower safety rings 50 and 160 respectively.

A secondary lower ring retainer 190 is attached to the lower ring-receiving frame 52 and has a similar relationship to the secondary lower ring 160 and to the lower frame 52 to that which the primary lower ring retainer 74 has to the primary lower ring 58 and to the lower frame 52.

In FIG. 1 a ring-releasing assembly 200 is shown having finger-engageable portions 210 on either end. When one of the finger-engaging portions 210 is pushed down, the other finger-engaging portion moves up. This allows the gate latch to be opened.

Gate tongue guides 220 are attached to each side of the post tongue 72 and arch downwardly therefrom. The guides 220 guide the gate latch 10 upwardly into a gate closed position as the gate 40 of FIG. 3 is swinging closed.

Figure 2:
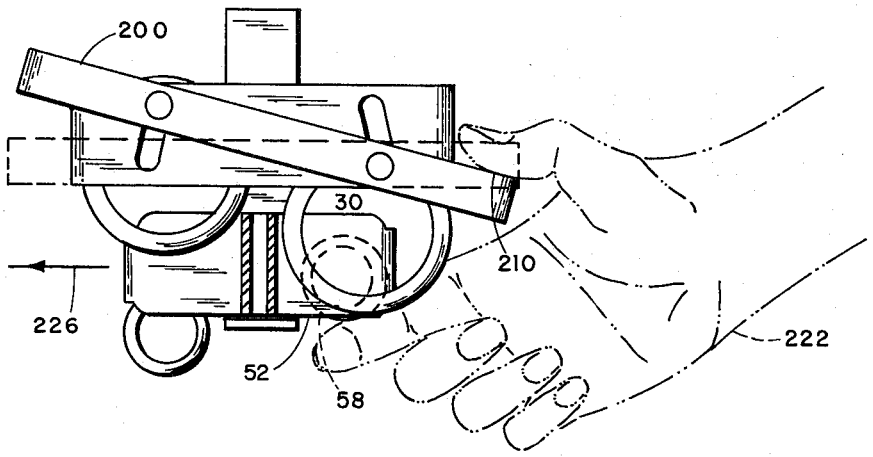
FIG. 2 shows the safety gate latch of FIG. 1 held in a position for opening of the gate by a hand, the original position of the ring-releasing assembly being shown in dotted lines.

In FIG. 2 a person's hand is shown in dotted lines at 222 pressing down with his thumb on a finger-engageable portion 210 of a ring-releasing assembly 200 while at the same time pushing with a finger upwardly on the primary lower safety ring 58 completely into the lower ring-receiving frame 52. This allows the tongue 30 to move out of the latched position in the direction of the arrow 226 and allows the gate, not shown, to be opened.

In FIG. 4, the gate tongue 30 is seen to have two spaced parallel mounting portions 228 which are held to the cylindrical vertical pipe gate end member 42 by a U-bolt 230. Outer tongue plates 234 are secured to each mounting portions 228 of the tongue 30 for added strength.

Figure 5:
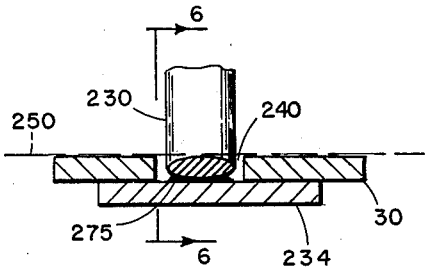
FIG. 5 is a sectional view of the gate tongue taken along the line 5—5 of FIG. 4.

FIG. 5 shows the gate tongue 30 to have a recess 240 in which the center or bottom of the U-bolt is held by a weld 275. The recess 240 allows the gate end portion to be held flat against the tongue 30 along the plane 250.

Figure 6:
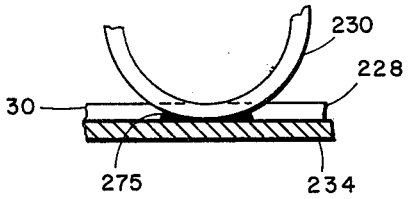
FIG. 6 is a sectional view of the gate tongue taken along the line 6—6 of FIG. 5.

The plane 250 is also seen in FIG. 6. Because the center of the U-bolt 230 isn't elevated from the tongue 30, the gate end portion 42 does not have to bend to adjust to two different levels and the tongue will not wobble.

I claim:

1. A safety gate latch system (10) comprising: an upper gate latch assembly (20) comprising a gate tongue (30) adapted to be attached to the free end of a gate latching portion (31), said tongue (30) swinging in a circular arc (50) in a horizontal plane and extending substantially radially with respect to said arc, an upper gate tongue securing assembly (60) comprising a first upper ring (64), said tongue (30) being disposed on a certain side (65) of said first upper ring (64) when said gate latch is in a gate-closed position, said first upper ring (64) having first and second opposite sides (66,68) lying in substantially vertical parallel planes each substantially tangent to said swinging arc, an upper ring-receiving frame means (80) having portions (82,84) disposed one on each of said sides of said first upper ring (64) for maintaining said sides (68) of said first upper ring (64) in said planes (90), said upper ring-receiving frame (80) having an upper ring-receiving recess means (96) therein moveably receiving said first upper ring (64), when said gate latch system (10) is in a latching position said first upper ring (64) having a lower outer surface portion (102) inclined with respect to the vertical and normally projecting downwardly from said upper ring-receiving frame means (80) in the path of the swinging of said tongue (30) whereby said first upper ring (64) is caused to move upwardly by the passing of said tongue under the center of said first upper ring (64), a first upper ring retainer (82) attached to said upper ring-receiving frame means (80) and extending approximately horizontally through the center opening (94) of said first upper ring (64) in a position such that when an upper portion of said first upper ring (64) engages said first upper ring retainer (82) the lower side of said first ring will be disposed below the upper surface (33) of the latching portion (31) of said tongue (30), a first upper ring-hold means (86) fixed to said upper ring-receiving frame means (80) and disposed on an opposite side of said first upper ring (64) from said certain side (65), said first upper ring holding means (86) having a lower surface disposed in a position for engaging said outer surface portion (102) of said first upper ring (64) at a time when said first upper ring (64 is in a gate-locking position, and said first upper ring retainer (82) engaging a wall of said central opening (96) of said first upper ring (64) when said latch is in a gate-latching position whereby when said gate latch is in a gate-holding position said tongue (30) is prevented from moving horizontally in a direction generally toward said first upper ring (64) to prevent said gate from accidentally opening in the respective direction, a second and similar gate latch assembly (50) for safety having like parts and comprising a lower ring-receiving frame means (52) fixed to said gate tongue (30), said lower ring-receiving frame means (52) having a lower ring-receiving recess means (56), a primary lower safety ring (58) mounted in said lower ring-receiving frame means (52) similarly to the way said first ring (64) is mounted in said upper frame (80), a post-tongue (72) for attachment to a gate post (110) and extending when said system is in a gate-latched position across the pathway of said primary lower safety ring (58), said second gate latch assembly having a primary lower safety ring retainer (74) and a primary lower safety ring-holding means (76) having the same relationships to said lower frame means (52) and to said primary lower ring (58) as said first upper ring retainer (82) and said first upper ring-holding means (86) have to said upper frame (80) and to said first upper ring (64), a second upper ring (150) substantially similar to said frist upper ring (64), said second upper ring (150) being disposing in said first recess means (96) of said upper frame means (80) and arranged substantially parallel to and spaced from said first upper ring (64) and horizontally spaced from said first upper ring (64) whereby in gate-closed position said gate tongue is in a space (170) between said first and second upper rings (64,150), a second upper upper ring retainer (154) attached to said upper ring-receiving frame means (80) and having a similar relationship to said second upper ring (150) and to said upper ring-receiving frame means (80) to that which said first upper ring retainer (82) has to said first upper ring (64) and to said first upper frame means (80), a secondary lower safety ring (160) substantially similar to said primary lower safety ring (58), said secondary lower safety ring (160) being disposed in said lower second ring-receiving recess means (56) and being arranged substantially parallel to and spaced from said primary lower safety ring (58) whereby in a gate-closed position said post-tongue (72) is disposed between said primary and secondary lower safety rings (50,160), a secondary lower ring retainer (200) attached to said lower ring-receiving frame means (52) and having a similar relationship to said secondary lower ring (160) and to said lower frame means (52) to that which said primary lower ring retainer (74) has to said primary lower ring (58) and to said lower frame means (52), a ring-releasing assembly means (200) having finger-engageable portions (210) on each side of said space (170) between said first and second upper rings (64,150), said finger-engageable portions (210) being operatively correlated with said first and second upper ring retainers (82,154) so that when one of said finger-engageable portions (210) is moved then that certain one of said first and second upper ring retainers (82,154) which is located on the opposite side of said space (170) between said first and second rings (64,150) of said one of said finger-engageable portions from said moved finger-engageable portion (210) will be raised so as to permit said tongue (30) to pass by under said certain one of said ring retainers (82,154) for gate opening when simultaneously the lower safety ring (58,160) on the same side of said space (170) as said moved finger-engageable portion (210) is raised to release said post tongue 72.

2. The safety gate latch system of claim 1 having a ring-releasing lever attached to each of said first ring and second ring retainers and being disposed exteriorly of said first ring-receiving frame so as to be hand-engageable, said first frame having first and second slot means, said first and second ring retainer being disposed in said first and second slot means respectively, said slot means being vertically elongated whereby when said lever is pressed down adjacent one of said slot means then that end of said lever which is adjacent the other of said slot means can rise up causing a raising of that one of said ring retainers which is disposed in said other slot means sufficiently to raise the respective ring sufficiently to raise the respective ring sufficiently to permit said gate latch to escape past that ring which is adjacent to said other slot means.

* * * * *